US005969689A

United States Patent [19]

Martek et al.

[11] Patent Number: 5,969,689

[45] Date of Patent: Oct. 19, 1999

[54] MULTI-SECTOR PIVOTAL ANTENNA SYSTEM AND METHOD

[75] Inventors: Gary Allen Martek, Kent; Douglas O. Reudink, Bellevue; Todd Elson, Seattle, all of Wash.

[73] Assignee: Metawave Communications Corporation, Redmond, Wash.

[21] Appl. No.: 08/782,051

[22] Filed: Jan. 13, 1997

[51] Int. Cl.[6] ..... H01Q 3/00; H01Q 21/00

[52] U.S. Cl. ..... 343/758; 343/879

[58] Field of Search ..... 343/814, 368, 343/853, 758, 879; 455/33.1

[56] References Cited

U.S. PATENT DOCUMENTS

| | | | |
|---|---|---|---|
| 4,101,901 | 7/1978 | Kommrusch | 343/853 |
| 4,779,097 | 10/1988 | Morchin | 342/368 |
| 5,038,149 | 8/1991 | Aubry et al. | 342/372 |
| 5,440,318 | 8/1995 | Butland et al. | 343/814 |
| 5,488,737 | 1/1996 | Harbin et al. | 455/33.1 |
| 5,539,415 | 7/1996 | Metzen et al. | 343/700 MS |
| 5,589,843 | 12/1996 | Meredith et al. | 343/820 |

*Primary Examiner*—Don Wong
*Assistant Examiner*—Jennifer H. Malos
*Attorney, Agent, or Firm*—Fulbright & Jaworski L.L.P.

[57] ABSTRACT

An omni directional coverage multibeam antenna composed of facets, or antenna modules, that make up a regular polygon of n sides inscribed in a circle of radius r which defines an adjustable composite conical surface. The disclosed antenna modules are independent antenna arrays creating an independent beam. One advantage of such a system is that the radiated wave front associated with such antenna modules is always substantially broadside to the array resulting in limited scan loss effects. Furthermore, the independence of the disclosed antenna modules is important as it allows each module's beam to be either electrically or mechanically steered to affect elevation or azimuthal beam control. Additionally, by employing trapezoidal shaped antenna modules, a minimum radome diameter is achieved that covers this antenna system.

41 Claims, 9 Drawing Sheets

MULTI-SECTOR PIVOTAL ANTENNA SYSTEM AND METHOD

TECHNICAL FIELD OF THE INVENTION

This invention relates to a multibeam antenna array and more particularly to an antenna array employing a composite conical shaped geometry to effect an omni-directional radiation pattern of adjustable size when all beams are superimposed.

BACKGROUND OF THE INVENTION

Planar array antennas when imposed to cover multiple directions, suffer from scan loss. Since the projected aperture decreases as the beam is steered away from the broadside position which is normal to the ground surface and centered to the surface itself, it follows that broadside excitation of a planar array yields maximum aperture projection. Accordingly, when a beam from such an antenna is off the normal axis, the projected aperture area decreases causing a scan loss which is a function of cosine having a value of 1 with the argument of zero radians (normal) and having a value of 0 when the argument is $\pi/2$.

$$Ati = 1l\left[\frac{4}{\lambda^2} * Ar * ( )\right]$$

There are a number of methods of beam steering using matrix type beam forming networks that can be made to adjust parameters as directed from a computer algorithm. This is the basis for adaptive arrays.

When a linear planar array is excited uniformly to produce a broadsided beam projection, the composite aperture distribution resembles a rectangular shape. When this shape is Fourier transformed in space, the resultant pattern is laden with high level side lobes relative to the main lobe. The $$SINC = \frac{\mathrm{SIN}(x)}{(x)}$$

function is thus produced in the far-field pattern. In most practical applications these high level side lobes are an undesirable side effect.

Additionally, changes in the environment surrounding a communication array or changes at a neighboring communication array may require adjustment of the radiation pattern of a particular communication array. Specifically, seasonal changes around a base transceiver station (BTS) site can cause changes in propagation losses of the signal radiated from a BTS. For example, during fall and winter deciduous foliage loss can cause a decrease in signal path loss. This can result in unintentional interference into neighboring BTS operating areas as the radiation pattern of the affected BTS will effectively enlarge due to the reduced propagation losses.

Likewise, an anomaly affecting a neighboring BTS may cause an increase in signal path loss, or complete interruption in the signal, therefore necessitating the expansion of the radiation patterns associated with various neighboring BTSes in order to provide coverage in the affected areas.

Previously, crews have had to be dispatched to purposely tilt BTS antennas up or down to minimize interference or provide coverage in neighboring areas. Likewise, crews have again had to be dispatched when the anomaly affecting the signal has dissipated or been resolved. It becomes readily apparent that compensation for such anomalies, even occurring only seasonally, can be quite expensive. Furthermore, as the communication system grows in complexity, more such adjustments have to be made to bring the system back up to full operating capacity.

Accordingly, a need exists in the art for an antenna system which provides for azimuthal beam placement about an array to provide multi-directional coverage without using the aforementioned adaptive techniques.

A further need exists in the art for such an antenna system whereby the beam aperture is relatively constant and broadside to its intended direction without producing undesirable high level side lobes.

A still further need exists in the art for an antenna system which provides for automated control of the various beams comprising a radiation pattern.

These and other objects and desires are achieved by an antenna design which relies on a composite of antennas to provide multiple beams which are automatically, or remotely, adjustable.

SUMMARY OF THE INVENTION

The foregoing and other needs and desires are met in a preferred embodiment of the present invention where an antenna array is constructed as an azimuthal constellation of individual and steerable beam antenna modules. The antenna modules are arranged circumferentially around a mast, or other supporting structure, to provide a predefined conical composite surface. Although the term conical composite surface is used herein, it shall be understood that an arrangement of antennas according to the present invention may include substantial surface interruptions there between. Moreover, an arrangement of antenna modules suitable for use in the present invention may present substantially no surface at all, but rather simply be arranged so as to abstractly define the surface shapes discussed herein.

The individual antenna modules may be configured in an azimuthal constellation of 2 to n antenna modules to provide omni-directional beam coverage about a BTS. Moreover, clusters of such constellations may be utilized to provide interlaced beams. For example, a four beam sub-system antenna can be placed in a triad, such as in a vertically diverse arrangement, to form a composite twelve beam system.

It is sometimes desirable to limit the radiation pattern of such an antenna system, as for example, so that a network of such systems can reuse an allocated set of frequencies repeatedly. Therefore, the "slope" of the conical composite surface formed by the constellation of antenna modules may be adjusted by tilting the individual antenna modules such that the composite surface "faces" downward at an angle, thereby creating on the ground a circumference within which the signal is propagated. Tilt, or elevation position, is defined as the angle between the axis of symmetry of the antenna module and the earth. Of course, tilt may also be adjusted electronically, such as by delaying excitation of various vertically placed antenna elements associated with an antenna module, thereby lowering the amount of mechanical adjustment required to aim the beam down in the elevation plane. Such electronic tilting may be substantially constant, such as by the inclusion of preset signal delay devices in the signal path of the various antenna elements. Additionally, electronic tilting may also be dynamic, such as by the inclusion of adjustable signal delay devices, adjustable by an associated control, in the signal path of the various antenna elements.

The initial angle of the composite surface may be selected to result in a desired composite radiation pattern of the antenna modules as projected about the antenna array. For example, the composite surface formed by the individual antenna modules could be substantially a "frustum of right circular cone". The larger radius of the two radii of the frustum, would be at the top, when mounted longitudinally. This would accommodate the "down-tilt" required for a system having a radiation pattern with a predetermined circumference. Of course, other composite shapes can be used, such as cylinders, parabolas or spheres to encompass airborne and space applications as well as differing terrestrial applications.

Furthermore, as previously discussed, changes in the environment surrounding an antenna array, or changes at a neighboring communication system, may require adjustment of the radiation pattern of a particular antenna array. Therefore, the "slope" of the conical composite surface may be adjusted by tilting the individual antenna modules such that the composite surface faces more "downward" or more "upward," thereby creating on the ground an adjusted circumference within which the signal is propagated. Similarly, individual antenna modules may be tilted to affect the ground circumference of the composite radiation pattern only in an area covered by the antenna module so tilted. The radiation pattern may be predictably adjusted with the understanding that, as the angle defining the cone becomes less acute, the greater the down-tilt at the composite surface and, thus, the smaller area of the radiation pattern about the antenna system.

Beam width and gain are functions of the particular antenna modules utilized in by the present invention. For example, the individual antenna modules may be a reflector antenna assembly such as a corner reflector assembly, parabolic reflector, or planar assembly of antenna elements. It shall be appreciated that although a composite surface formed by such antenna modules is described herein as being substantially conical, the individual antenna modules making up a constellation of planar arrays may be described as a regular polygon having n sides, and a constellation of corner reflectors may be described as a regular polygon of 2n sides (where n is the number of arrays or corner reflectors).

Of course, although antenna arrays having a reflective ground surface are discussed herein, any antenna elements/modules which provide a defined directional beam may be utilized by the present invention, if desired. However, it shall be appreciated that some such antenna elements/modules may not present a composite surface, but rather an arrangement of antennas that abstracted azimuthally, may be thought of as conical in shape.

A corner reflector has at least three physically adjustable parameters; beam width, beam tilt, and azimuth position. Beam width is a function of the distance between the antenna elements, such as dipoles, and the vertex of the corner reflector as well as the angle at which the corner is formed. Additionally, beam width may be controlled through the use of parasitic antenna elements. Beam tilt may be physically adjusted by tilting the assembly in the elevational plane. Likewise, azimuth position may be physically adjusted by positioning the assembly in the azimuthal plane.

For planar antennas, beam width can be controlled by the use of perpendicular edge reflectors at the edge of the panel antenna structure. The size and angle of such reflectors with respect to the plane of the panel antenna may be physically adjusted to affect the beam width. Similarly, beam width can be controlled through the use of a plurality of antenna elements energized so as to produce a wave front exhibiting a desirable beam width. Likewise, beam width is controllable through the use of parasitic antenna elements associated with the panel antenna structure. Moreover, the beam width of such a panel may be controlled by a combination of the aforementioned. However, preferably the use of such techniques to control beam width are selected to result in an acceptable level of side lobe radiation. Like the aforementioned corner reflector, tilt and azimuth position of planar arrays may be physically adjusted. Additionally, azimuthal beam steering may be accomplished through the use of a plurality of antenna elements energized so as to produce a wave front propagating in a desired direction.

It shall be appreciated that, according to the present invention, any of the above described antenna adaptive techniques, either alone or in combination, may be predetermined and/or dynamically controlled to produce a desired radiation pattern. Moreover, any polarization scheme obtainable by use of such antenna modules may be used with the present invention. For example, the use of circular or orthogonal linear polarization may be utilized by such an antenna array to provide polarization diversity. Similarly, symmetrical spatial diversity systems can be employed to affect azimuthal spatial diversity as well as minimal scan loss while maintaining individual antenna down-tilt capability. Such systems can be affixed on the same supporting mast and separated vertically by at least $10*\lambda$ to affect spatial diversity in the elevation plane as well.

As illustrated above, regardless of the particular form of the individual antenna modules, the antenna parameters affecting beam tilt, or elevation, and beam width can be controlled. According to the present invention, these parameters may be controlled electronically so as to automatically adjust these characteristics at the discretion of a system operator or control processor. Of course, the individual antenna modules may also supply a manual override of these electronically controlled parameters, where manual intervention is deemed necessary.

Preferably, the above described system is electronically controllable by sending appropriate signals to positioning actuators that control the amount of tilt of the antenna modules. In an alternative preferred embodiment, beam width is electronically controllable by sending appropriate signals to positioning actuators that control the placement, or angle, of reflectors, antenna elements, and/or parasitic elements of the antenna modules. A controlling algorithm can make any such adjustment as a result of signal/channel quality parameters, such as carrier to interference (C to I) ratio, received signal strength indicator (RSSI) or the like. Although this system is adaptive, the feedback causes a change in the physical position of the antennas rather than the electrical relationship between unit elements of the antenna, as is done in prior art adaptive antennas.

It shall be appreciated that the aforementioned non-physical, i.e., electronic, adaptive techniques may be used in combination with the physical positioning techniques of the present invention. Such electrical adaptive techniques, for example, may be utilized to lessen the physical adjustment required to achieve a particular result or to make incremental adjustment between or beyond physical adjustment limits.

An advantage of the present invention is that advantages of an adaptive antenna are realized without the aforementioned disadvantages associated with electronic beam steering techniques. Moreover, such advantages are realized without the need for expensive maintenance crews deployed for such physical adjustments.

The entire structure of the present invention may be contained within a radio frequency transparent radome.

Moreover, the same radome on the same mast may be utilized to contain multiple antenna arrays such as a receive and transmit antenna array. Similarly, multiple constellations of antenna modules providing interlaced receive or transmit beams may be contained within a single transparent radome. Of course, separate radomes provided on the same or different masts may be utilized to contain separate receive and transmit or interlaced radiation pattern arrays, if desired.

It shall be appreciated that the enclosure of the antenna structure of the present invention results in a more aesthetically pleasing facade being presented to those who view it. For example the radome may be shaped or colored so as to more pleasantly integrate with its surroundings. Of course, size and shape of such a radome is dictated to a large extent by the antenna structure contained therein.

In a preferred embodiment, the antenna modules of the present invention are shaped and placed so as to minimize the size of a radome containing the array. For example, the above described planar modules may be shaped as trapezoids or "back to back" trapezoidal shapes (i.e., hexagon consisting of a trapezoidal top half and a trapezoidal bottom half). This shape allows a small diameter radome to be used while still providing interior space in which to accommodate antenna module tilt.

Similarly, other antenna module shapes, such as circular, elliptical, or triangular, may also be utilized to allow a small diameter radome to contain the structure.

The small diameter realizable through such antenna module shaping provides the antenna system with a slender profile, i.e., a large aspect ratio. Such an aspect ratio is important regarding the aesthetic attributes of this antenna system. It is anticipated that antenna aesthetic attributes will grow to become an ever more important consideration by wireless service providers as these business entities acquire property and building permits for new and existing sites.

Accordingly, it is one technical advantage of my invention to provide an antenna system which relies on the placement of a plurality of antenna modules arranged to provide directional coverage while eliminating, or minimizing, the effects of scan loss.

It is an additional technical advantage of my invention that the plurality of antenna modules substantially form a "frustum of a right circular cone" (a right circular cone with its tip blunted), which allows the system to create "down-tilt" to control the radiation pattern.

It is a further technical advantage of my invention to provide automated adjustment of the angle of down-tilt of antenna modules to periodically control the radiation pattern without the need to dispatch service personnel.

A still further technical advantage of my invention is to utilize automated adjustment of reflectors, parasitic elements, and/or energization of associated antenna elements to provide beam width control without the need to dispatch service personnel. Such beam width control is effective in "isolating" energy radiated from specific antenna modules from energy radiated from other specific antenna modules.

A yet further technical advantage of my invention is to utilize shaping of antenna modules to provide a system in which the antenna array may be contained within a radome of minimum size while still allowing for adjustment of the tilt angle of such antenna modules.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Figure 1A:
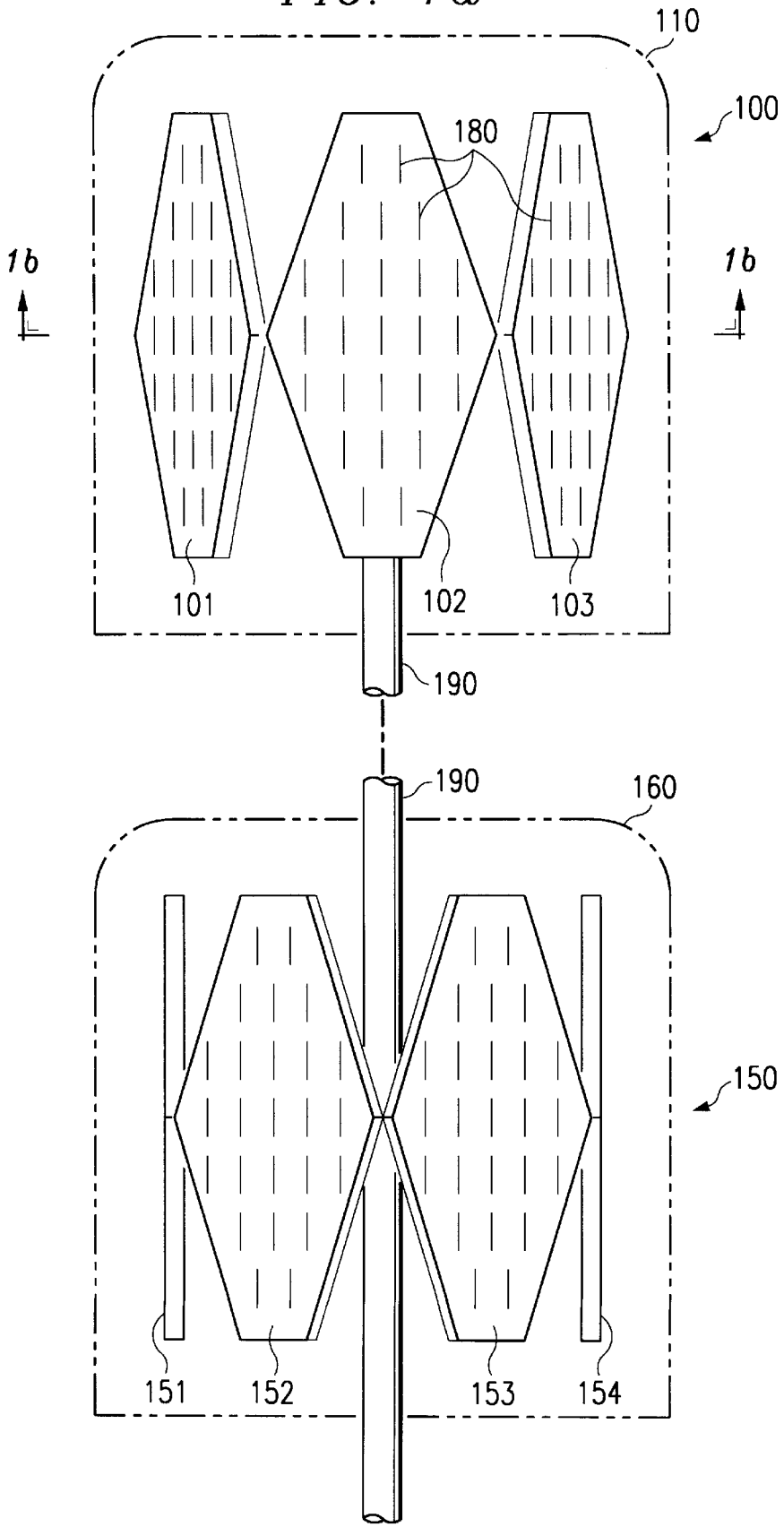
FIG. 1*a* illustrates two constellations of antenna modules according to the present invention.

Directing attention to FIG. 1*a*, a preferred embodiment of the inventive antenna system is shown as antenna cluster 100 having a constellation of individual antenna modules with antenna elements 180 disposed thereon, all contained within radome 110. It shall be appreciated that the enclosure of the antenna structure of the present invention within a radome results in a more aesthetically pleasing facade being presented but may be eliminated if desired. Moreover, in order to easily integrate with the environment in which it is placed, the radome may be specifically shaped or colored consistent with its environment.

Although planar antenna modules are depicted in FIG. 1*a*, it shall be appreciated that any antenna module producing a substantially directional beam may be utilized according to the present invention. For example, ones of the antenna modules of FIG. 1*a* may be replaced with corner reflector antenna modules well known in the art, if desired.

It shall be appreciated that the antenna modules of the present invention are adapted to result in radiated energy having a predetermined directional beam. For example, the shape and location of each antenna element 180 associated with a particular antenna module is selected to result in a radiation pattern, created through their summed radiated energy, having a predetermined primary lobe, or beam, associated with each antenna module. Additionally, or in the alternative, reflectors (not shown), such as placed along the edges of the antenna module, as well as parasitic elements (not shown), either directive or reflective, as are well known in the art, may be utilized to produce a beam associated with the antenna module having desired characteristics.

Figure 3A:
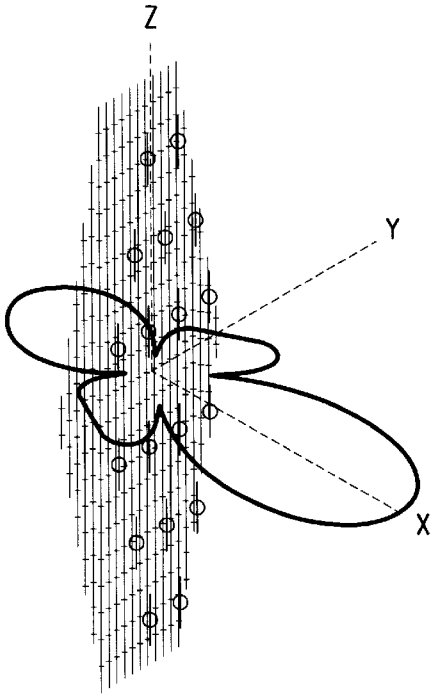
FIGS. 3*a*–3*c* illustrate a wire view of a planar antenna module of the present invention and its estimated azimuthal and elevational far-field radiation patterns using the method of moments.
Figure 3B:
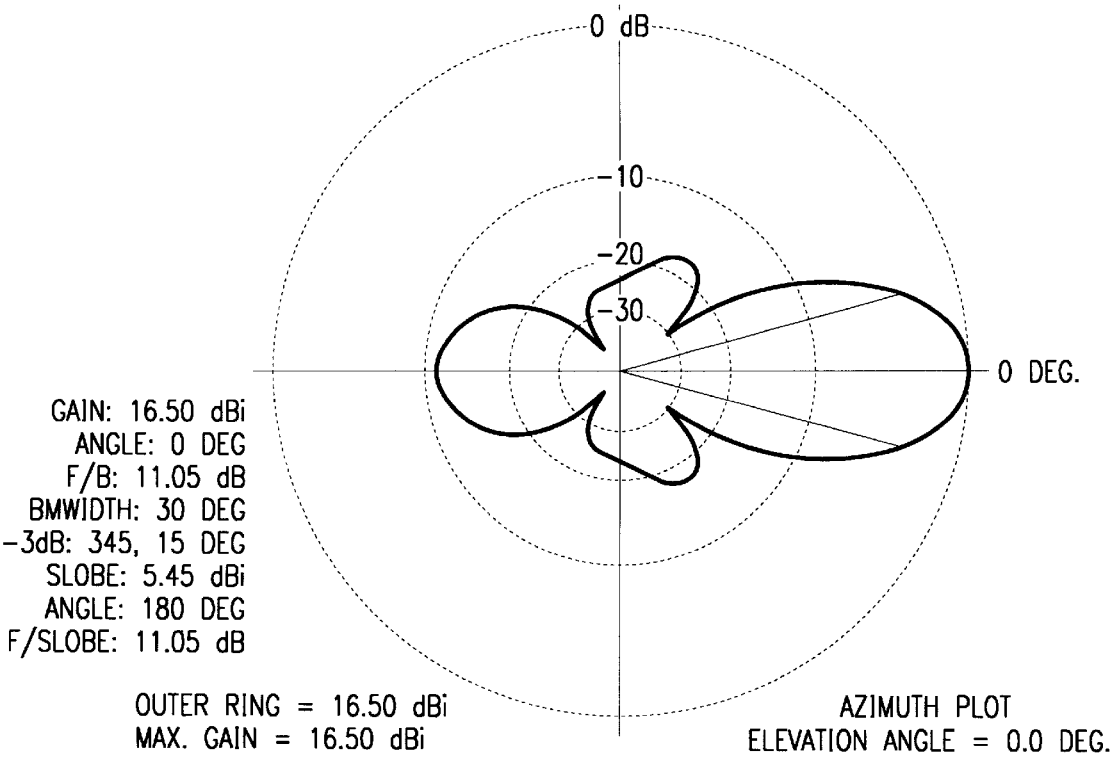
Figure 3C:
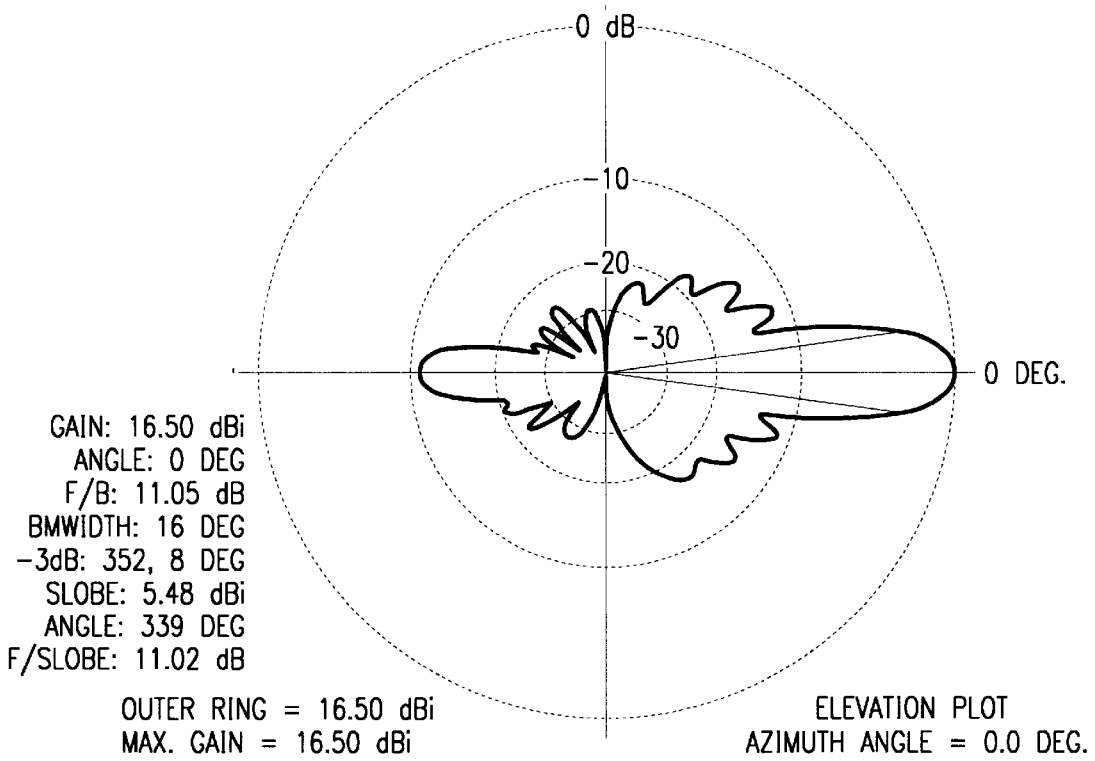

Directing attention to FIG. 3*a*, a wire view model of the preferred planar antenna module illustrated in FIG. 1*a* can be seen having a plot of the azimuthal far-field radiation pattern imposed thereon. Referring to FIG. 3*b* this azimuthal far-field radiation pattern is more clearly illustrated. Here it can be appreciated that the planar antenna module provides a radiation pattern having a well defined primary lobe, or beam. Of course, the attributes of this beam may be adjusted by altering the placement of the individual antenna elements and/or the addition of reflective or directional elements. FIG. 3*c* illustrates the elevational far-field radiation pattern of the wire model illustrated in FIG. 3*a*.

Figure 1B:
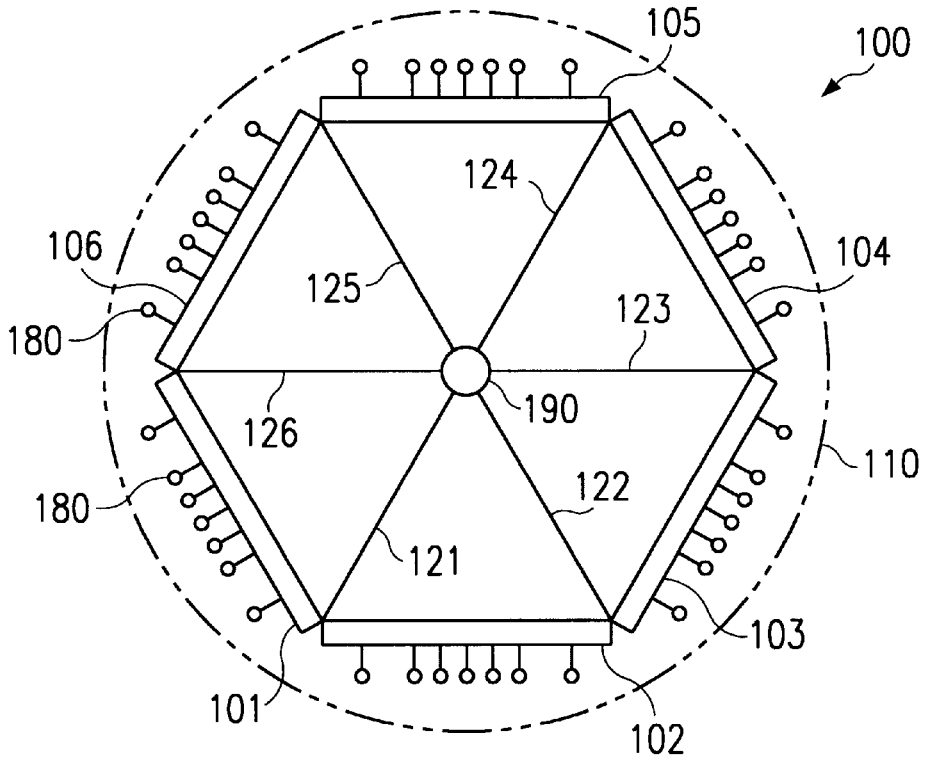
FIG. 1*b* illustrates a cross-sectional overhead view of an antenna constellation of FIG. 1*a;*

From FIG. 1*b* it can be seen that the antenna modules of the present invention are preferably circumferentially disposed about mast 190. Here, antenna modules 101 through 106, supported by mast 190 and support structures 121 through 126, are disposed radially so as to provide a substantially omni-directional radiation pattern formed as a composite of their individual beams.

Figure 4A:
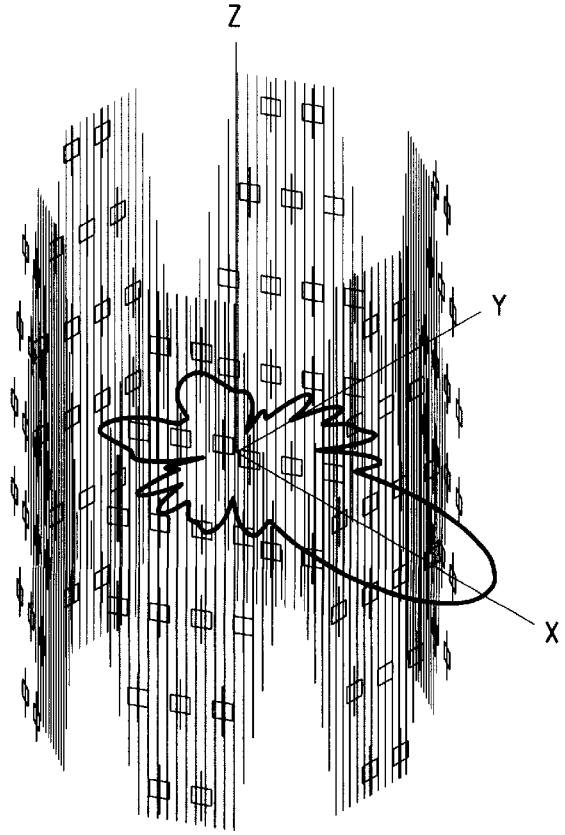
FIGS. 4*a*–4*c* illustrate a wire view of a cluster of planar antenna modules of the present invention and its estimated azimuthal and elevational far-field radiation patterns using the method of moments.
Figure 4B:
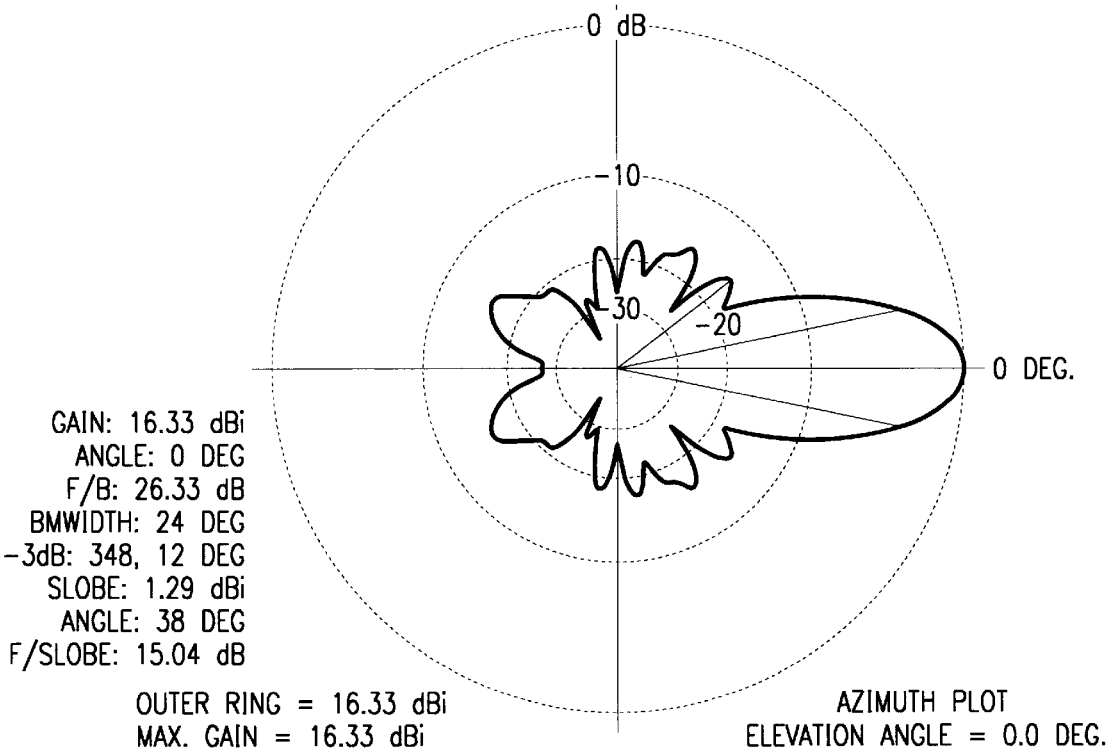
Figure 4C:
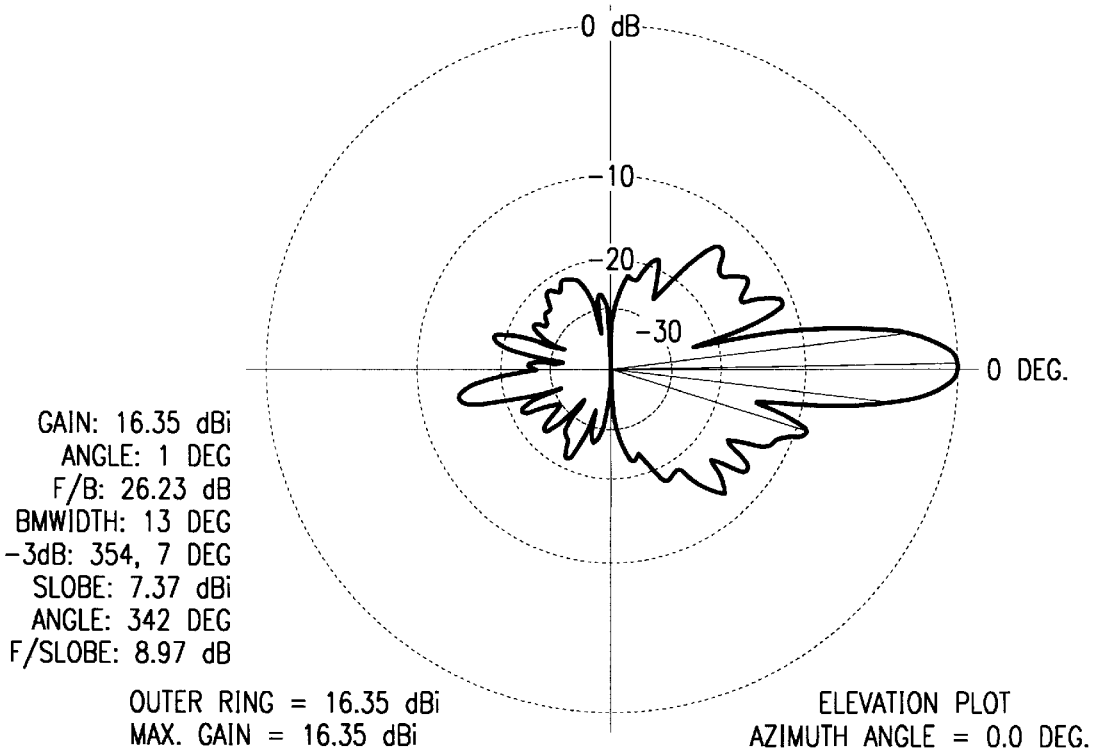

Directing attention to FIG. 4*a*, a wire view model of a constellation of six planar antenna modules disposed radially, as illustrated in FIG. 1*b*, can be seen having a plot of the azimuthal far-field radiation pattern of one antenna module imposed thereon. Referring to FIG. 4*b* this azimuthal far-field radiation pattern is more clearly illustrated. As with the individual planar antenna module, the antenna cluster provides a radiation pattern emanating from each antenna module having a well defined beam. FIG. 4*c* illustrates the elevational far-field radiation pattern of an antenna module of the wire model illustrated in FIG. 4*a*.

Figure 1C:
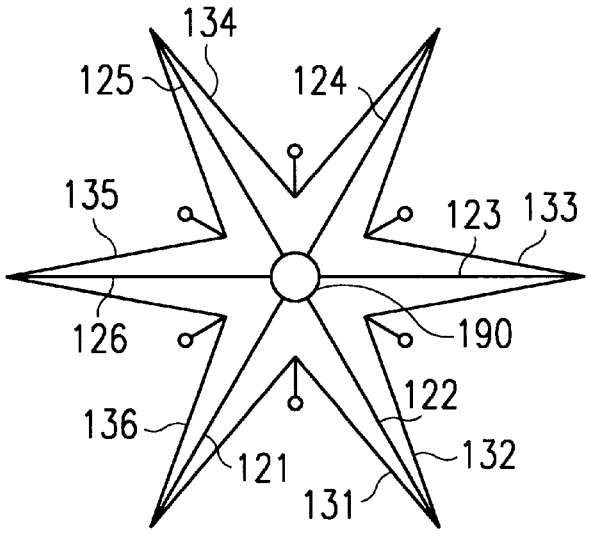
FIG. 1*c* illustrates a cross-sectional overhead view of an alternative embodiment utilizing corner reflector antenna modules.

FIG. 1*c* shows an alternative embodiment composed of corner reflector antenna modules circumferentially disposed about mast 190. Like the previously described embodiment, antenna modules 131 through 136, supported by mast 190 and support structures 121 through 126, are disposed radially so as to provide a substantially omni-directional radiation pattern formed as a composite of their individual beams.

Figure 5A:
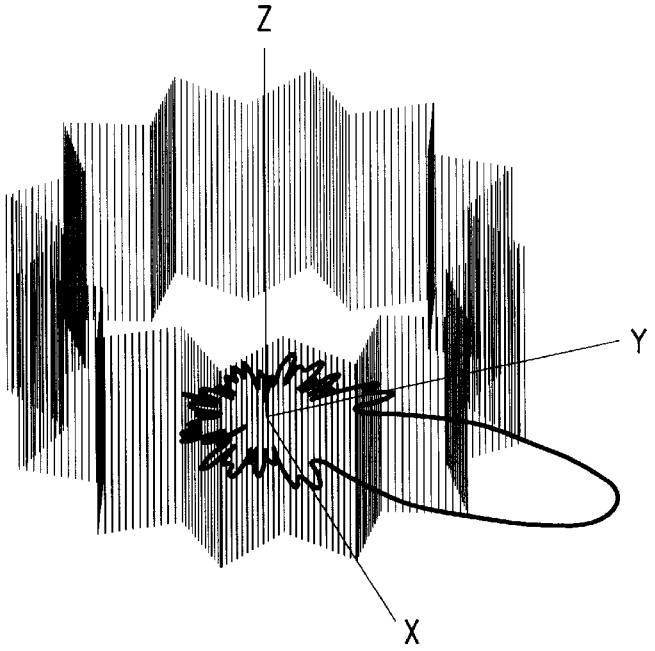
FIGS. 5*a*–5*c* illustrate a wire view of a cluster of corner reflector modules of the present invention and its estimated azimuthal and elevational far-field radiation patterns using the method of moments.
Figure 5B:
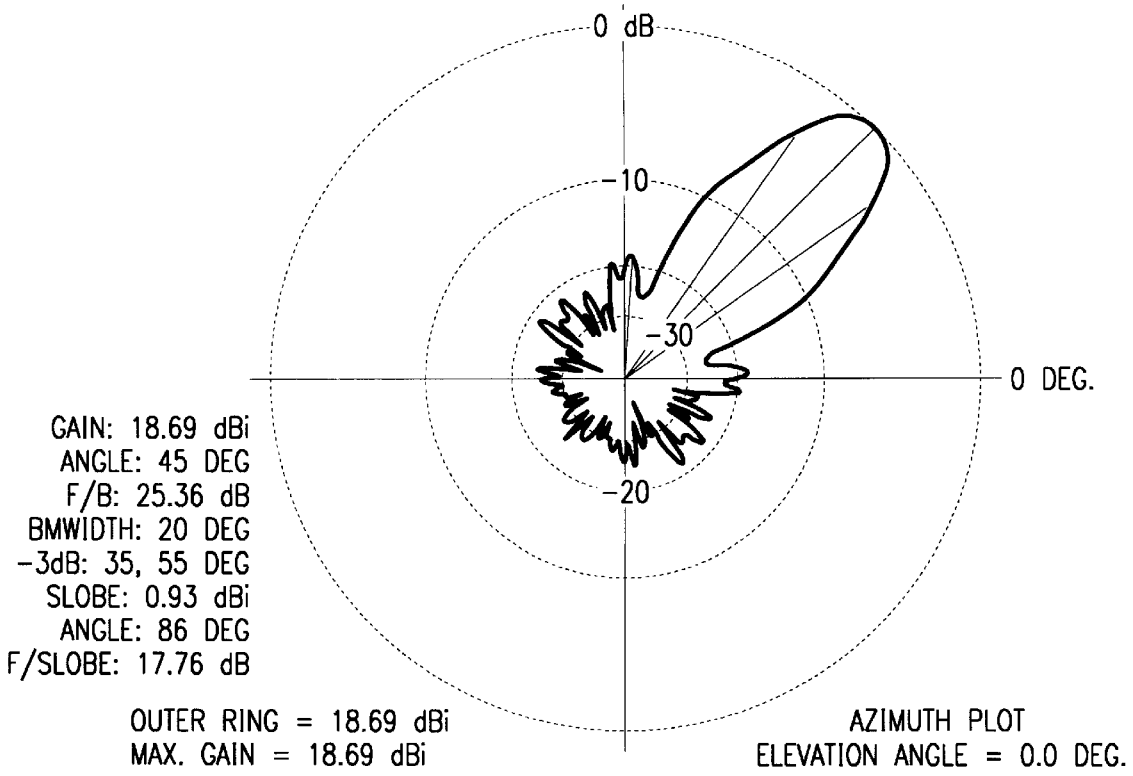
Figure 5C:
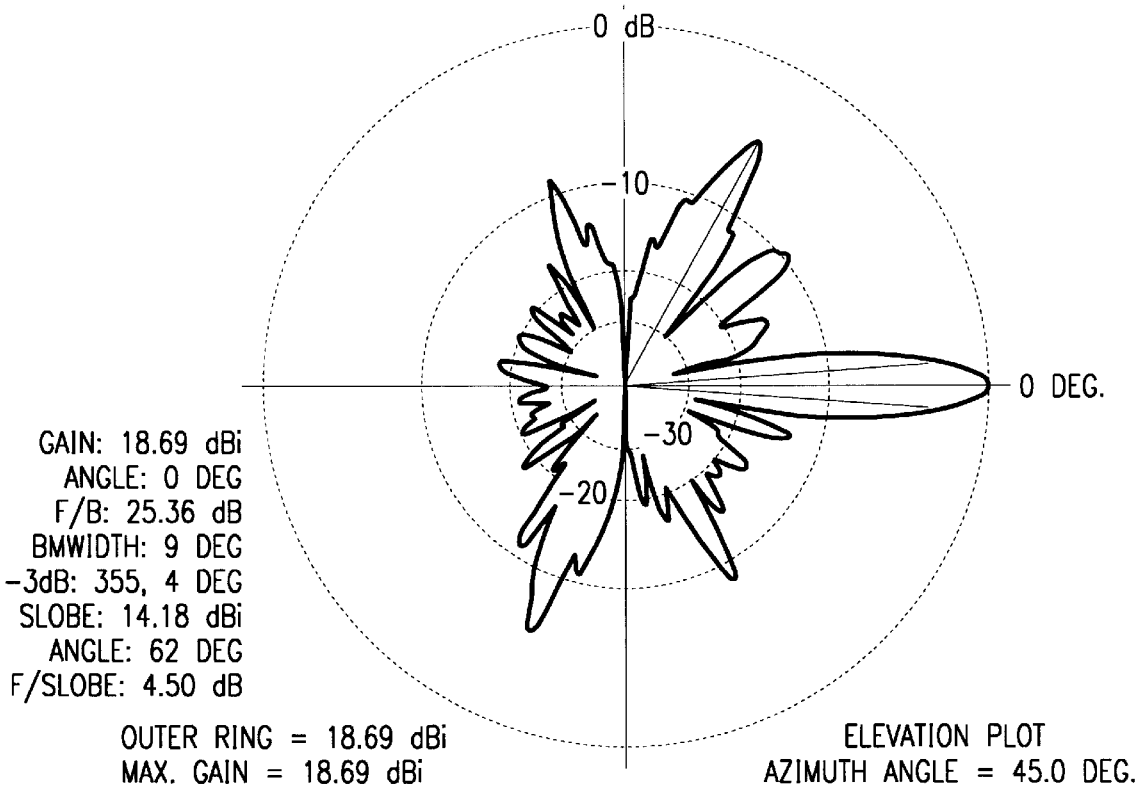

With reference to FIG. 5*a*, a wire view model of an alternative embodiment, having a constellation of twelve corner reflector antenna modules disposed radially, can be seen having a plot of the azimuthal far-field radiation pattern of one antenna module imposed thereon. In FIG. 5*b* this azimuthal far-field radiation pattern is illustrated without the wire view model. As with the above described cluster of planar antenna modules, the corner reflector antenna cluster provides a radiation pattern emanating from each antenna module having a well defined beam. FIG. 5*c* illustrates the elevational far-field radiation pattern of an antenna module of the wire model illustrated in FIG. 5*a*.

Referring again to FIG. 1*a*, it shall be appreciated that a substantially conical shaped surface is presented by the faces of antenna modules 101 through 106. This substantially conical surface defined by the composite of antenna module faces shall hereinafter be referred to as a hybrid right circular cone. The term "hybrid" is used to denote the fact that a frustum of the conic shape does not reveal a circle, but rather a circular pattern of the antenna modules, i.e., in the preferred embodiment a regular polygon. It shall be understood that, where antenna modules other than the illustrated planar modules are used, the hybrid cone resulting from their surfaces will vary depending on the antenna modules used. For example, where corner reflector antenna modules are used, the hybrid cone will be a polygon having a number of sides at least twice that of the number of antenna modules.

It shall be appreciated that any number of antenna modules may be utilized by the present invention. However, as the number of antenna modules placed in a single cluster about the support structure has a direct effect on the aspect ratio of the antenna system, ones of the antenna modules may be divided into multiple clusters associated as a single constellation.

FIG. 1*a* illustrates multiple clusters of antenna modules on a single mast as antenna clusters 100 and 150. It shall be appreciated that antenna cluster 150 is substantially identical to previously discussed antenna cluster 100. Antenna cluster 150 includes additional individual antenna modules 151 through 154 (shown) as well as two antenna modules (not shown) enclosed in radome 160.

It shall be appreciated that antenna cluster 150 is offset azimuthally from antenna cluster 100. Such an offset is to provide interlacing of the various beams of the two antenna clusters to provide a radiation pattern having omni-directional coverage.

An arrangement of multiple antenna clusters as illustrated in FIG. 1*a* is advantageous in providing a radiation pattern composed of multiple narrow beams with a system having a slim aspect ratio. For example, in order to provide substantially homogenous coverage in a 360° radius with only the six antenna modules of antenna cluster 100, the beams of the individual clusters would have to provide approximately 60° beam widths. However, where more narrow beams are desired, such as for example to provide more angular diversity among the signals, beams of 30°, for example, might be desired. It shall be appreciated, in order to provide the desired substantially homogenous coverage in a 360° radius with antenna modules providing a single beam, that use of 30° beams requires twelve antenna modules. A single cluster of twelve antenna modules will produce a larger circumference hybrid cone than that of the six antenna module cluster. Therefore, separating the antenna modules into multiple associated clusters presents a slimmer aspect ratio antenna system capable of providing a large number of individual beams.

It shall be understood that, although the use of multiple antenna clusters is discussed in conjunction with providing a radiation pattern having interlaced narrow beams, so too may the multiple cluster arrangement be utilized to provide non-interlaced radiation patterns. For example, antenna cluster 100 could be utilized to provide BTS transmit signals while antenna cluster 150 is utilized to provide BTS receive signals. Of course, where the multiple clusters are used to provide separate receive and transmit signals, it may be advantageous to align the antenna modules of the different antenna clusters so as to provide substantially overlapping individual beams; i.e., antenna module 152 of cluster 150 rotated azimuthally to align with antenna module 102 of cluster 100.

Figure 2:
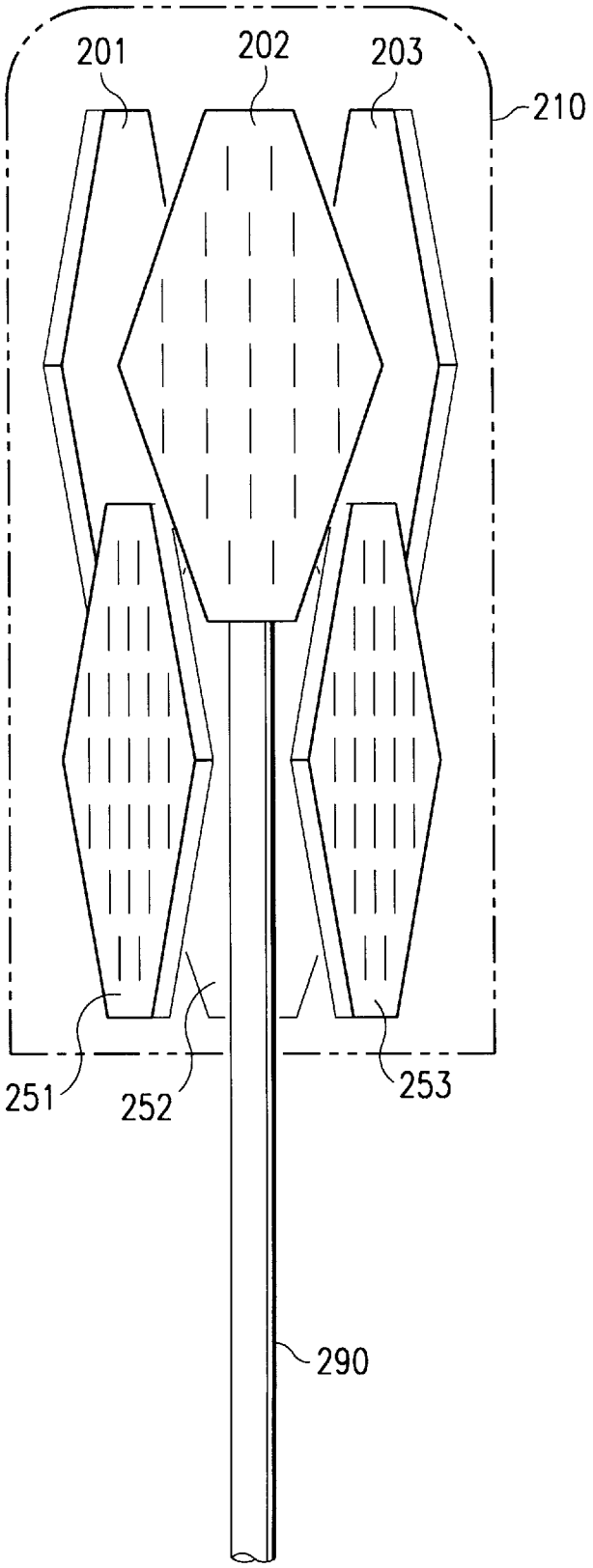
FIG. 2 illustrates two constellations of antenna modules disposed in interlaced fashion.

It shall be appreciated, although individual clusters having independent radomes is illustrated in FIG. 1*a*, that a multiple cluster system may be enclosed within a single radome as is illustrated in FIG. 2. Here radome 210 encloses a first antenna cluster having antenna modules 201 through

203 and a second antenna cluster having antenna modules 251 through 253, all supported by mast 290. Moreover, through specific shaping of the antenna modules, as is discussed hereinafter, the vertical size of the antenna system may be reduced by physically interlacing the antenna clusters.

Of course, size and shape of the antenna system is dictated to a large extent by the individual antenna modules contained therein. Not only does the latitudinal width of each antenna module of a cluster forming a hybrid cone militate a minimum width of a containing radome, but so too does the shape of the face of the antenna modules, where such modules are to be tilted from the vertical as is discussed hereinafter.

In a preferred embodiment, the antenna modules, such as module 102, present a face shaped as a "back to back" trapezoid, i.e., a shape having a trapezoidal top half butted against a trapezoidal bottom half, as is depicted in FIG. 1*a*. This shape allows a smaller diameter radome to be used to contain the antenna cluster, while still providing interior space in which to accommodate antenna module tilt, than if the antenna modules were squared off at the top and/or bottom.

Of course, shapes other than the above described back to back trapezoid may be utilized by the present invention to provide the desired directional beam as well as a shape suitable for tiltable mounting within a small diameter radome. For example, the individual antenna modules could be oval in shape and still provide a face suitable for use in a small diameter radome. Likewise, the antenna modules might be back to back triangles and provide a face suitable for the aforementioned tiltable mounting in radome of small diameter.

It shall be appreciated that the small diameter radome realizable through the above discussed antenna module shaping provides the antenna system with a slender profile, i.e., a large aspect ratio. Such an aspect ratio is important regarding the aesthetic attributes of this antenna system.

Furthermore, the above discussed antenna module shaping may be utilized to provide gaps in the hybrid cone at the distal, i.e., the top and bottom, ends of antenna modules suitable for physically interlacing multiple antenna clusters. As discussed above, such physical interlacing of multiple clusters reduces the overall height of the antenna system, further enhancing the aesthetic attributes of this antenna system.

As it is often desirable to limit the radiation pattern of an antenna system such as that formed by the antenna clusters disclosed herein, as for example, so that a network of such systems can reuse an allocated set of frequencies repeatedly, the "slope," or angle, of the hybrid cone formed by the constellation of antenna modules may be initially adjusted by tilting the individual antenna modules. For example, disposing the larger radius of the two radii of the hybrid frustum cone at the top, when mounted longitudinally, accommodates the "down-tilt" required for a system having a radiation pattern with a predetermined circumference. By such tilting, the "faces" of the antenna modules may be disposed to angle downward, thereby creating on the ground a circumference within which the signal is propagated.

In addition to physically adjusting the faces of the antenna modules downward, tilt may also be adjusted electronically. By delaying excitation of various vertically placed antenna elements elevational beam steering, well known in the art, may be accomplished. Such electronic beam steering may be utilized to supplement the aforementioned physical tilting, thereby lowering the amount of mechanical adjustment required to aim the beam down in the elevation plane. Similarly, electronic beam steering may be used for other purposes, such as to provide incremental beam steering between predefined physical tilt settings, where deemed advantageous.

It shall be appreciated that the aforementioned beam steering may also be utilized by the present invention to provide azimuthal adjustment of the beams of the antenna modules. Of course, for azimuthal beam steering, delaying excitation of various horizontally placed antenna elements, rather than vertically placed elements, is utilized.

Changes in the environment surrounding an antenna array, or changes at a neighboring communication system, may require adjustment of the radiation pattern of a particular antenna array to avoid undesirable communication characteristics such as co-channel interference, low C to I ratio, excess energy density, and the like. Therefore, the "slope" of the hybrid conical surface may require subsequent adjustment, such as by tilting the individual antenna modules to face more "downward" or more "upward," thereby creating on the ground an adjusted circumference within which the signal is propagated. Similarly, individual antenna modules may be tilted to affect the ground circumference of the composite radiation pattern only in an area covered by the antenna module so tilted. The radiation pattern may be predictably adjusted with the understanding that, as the angle defining the cone becomes less acute, the greater the down-tilt at the composite surface and, thus, the smaller area of the radiation pattern about the antenna system.

Preferably, tilting of the various antenna modules of the present invention is controlled electronically so as to provide automatic, or remote, adjustment of this characteristic under the control of a control processor. Of course, such control may also be at the discretion of a system operator, if desired. Likewise, the individual antenna modules may also supply a manual override of electronically controlled parameters, for use where manual intervention is deemed necessary.

Figure 6:
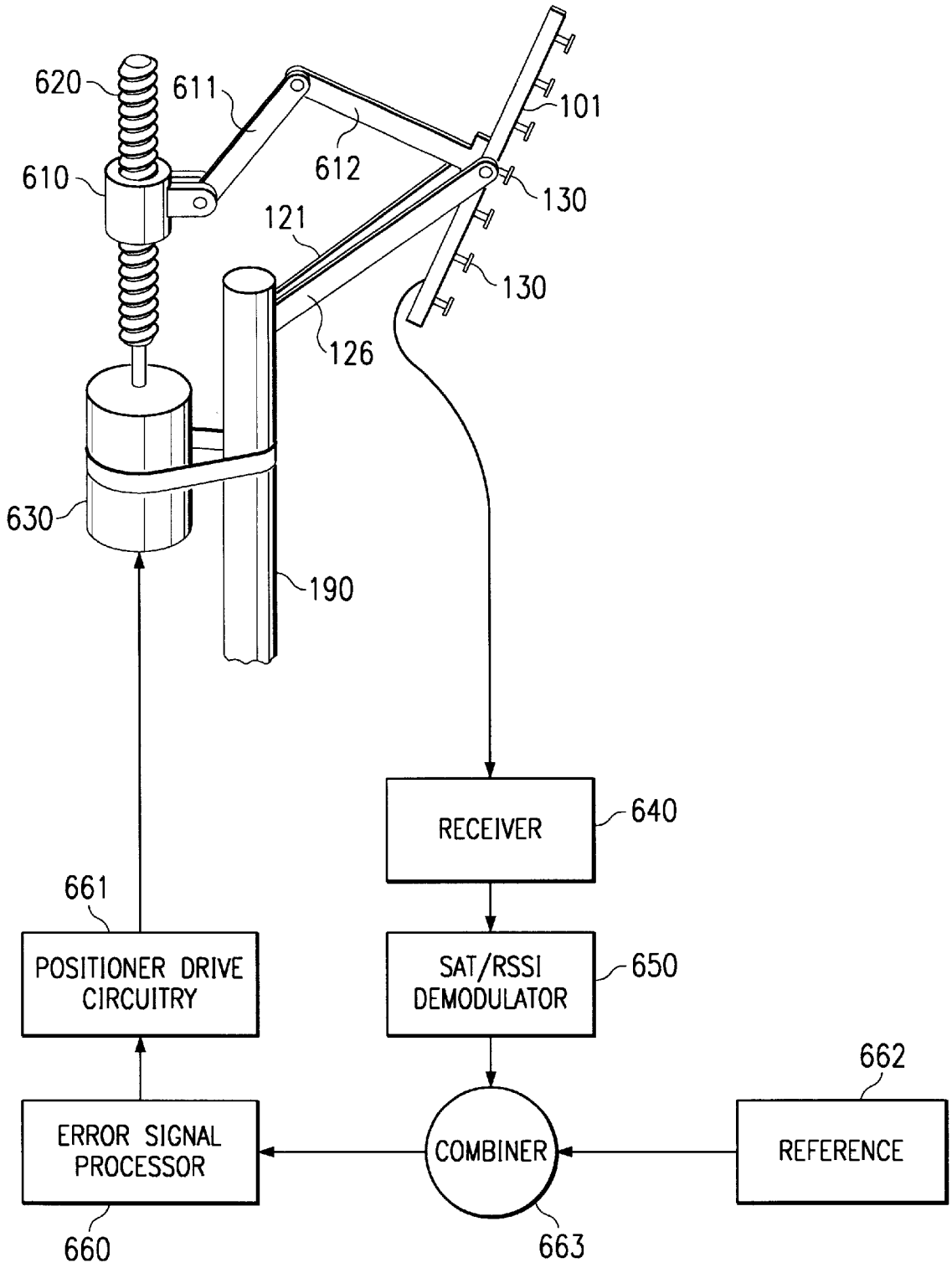
FIG. 6 illustrates an automated antenna adjustment system according to the present invention.

A preferred embodiment of a system for electronically adjusting the tilt of an antenna module under the control of a control processor is shown in FIG. 6. Here, as in FIG. 1*b*, antenna module 101 is supported by mast 190 and by support structures 121 and 126. However, to provide for the aforementioned tilting, it shall be appreciated that antenna module 101 is pivotally connected to support structures 121 and 126. Of course, any tiltable mounting technique may be utilized by the present invention.

Collar 610 is adapted to receive screw 620 attached to positioner motor 630. Thus, activating positioner motor 630 results in the vertical movement of collar 610. This movement is translated to tilting of antenna module 101 through arms 611 and 612. For example, activation of positioner motor 630 causing collar 610 to proceed down the threads of screw 620, toward positioner motor 630, will cause an upward tilt of antenna module 101. Similarly, activation of positioner motor 630 causing collar 610 to proceed up the treads of screw 620, away from positioner motor 630, will cause a downward tilt of antenna module 101. Of course, there are numerous methods of causing the automated adjustment of the antenna modules of the present invention, any of which may be substituted for the preferred embodiment illustrated in FIG. 6.

Although a single antenna module is illustrated linked to position motor 630, it shall be appreciated that several or all antenna modules of the present invention may be so linked. For example, a link arm set, such as arms 611 and 612, may be coupled to each antenna module and to collar 610. Of course, where individual control of each antenna module is desired, individual control systems as illustrated in FIG. 6 may be utilized for each antenna element. In a preferred embodiment the above described adjustment of the antenna modules of the present invention is automatically controllable by control circuitry such as is illustrated in FIG. 6. Preferably, automated control of the tilting of the antenna modules is accomplished by providing a communication parameter signal, such as is discriminated from a received signal by receiver 640 in combination with supervisory audio tone/receive signal strength indicator (SAT/RSSI) demodulator 650, to a control circuitry, such as is provided by error signal processor 660, positioner drive circuitry 661, reference signal generator 662, and signal combiner 663. It shall be appreciated that a receiver and SAT/RSSI demodulator, such as receiver 640 and SAT/RSSI demodulator 650, are typically utilized with cellular telephone BTSes and, therefore, may be utilized without the addition of such circuitry.

Automated control of tilting of the antenna modules is provided when positioner drive circuitry 661 provides a control signal to positioner motor 630 under control of error signal processor 660. Error signal processor 660 is a processor-based system including a processing unit (CPU) and memory (RAM). Within the RAM of processor 660 is an algorithm executable on the CPU to provide positioner control in response to supplied communication parameters.

Preferably, communication parameters provided to processor 660 are those demodulated by SAT/RSSI demodulator 650. In order to provide communication parameters necessary for the proper operation of positioner drive circuitry 661, preferably the output signal of SAT/RSSI demodulator 650 is combined with a signal from reference signal generator 662 by combiner 663.

It shall be appreciated that reference signal generator 662 may be adapted to provide a signal such that when it is combined with the output of SAT/RSSI demodulator 650, that SAT/RSSI signals associated with the coupled antenna module, or even other antenna modules of this BTS, are eliminated, leaving only "foreign" SAT/RSSI signals to be communicated to processor 660. Of course, any number of methods suitable to provide processor 660 with communication parameters indicating the need to adjust the antenna system may be utilized, if desired.

Figure 7:
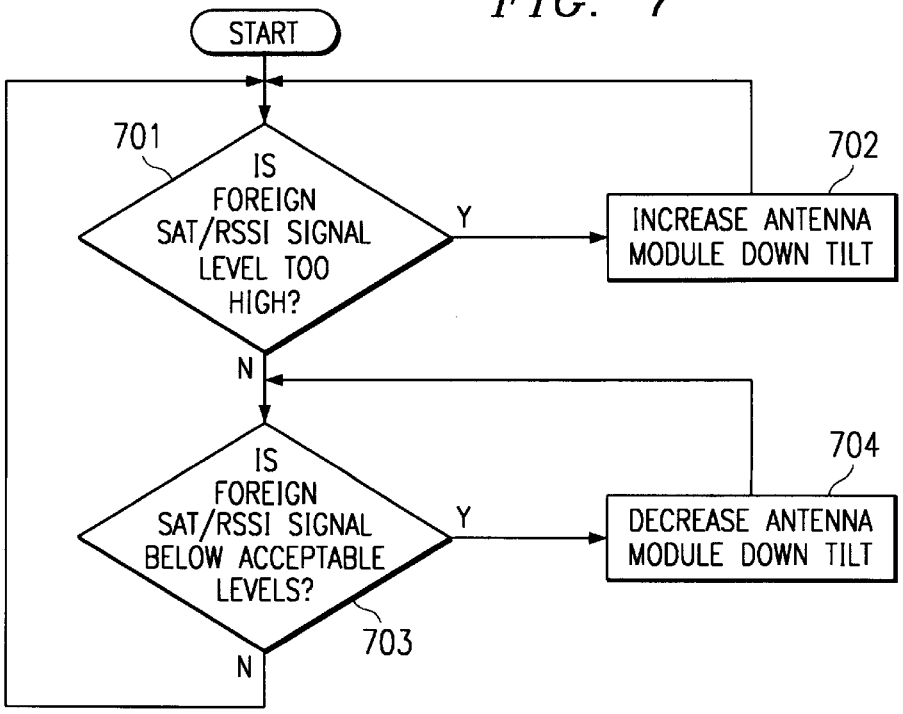
FIG. 7 is a flow diagram of an antenna module adjustment control algorithm according to the present invention.

A block diagram of a preferred embodiment of the steps performed by the algorithm of processor 660 is illustrated in FIG. 7. At step 701, processor 660 determines if the foreign SAT/RSSI signal level is above acceptable limits, indicating undesirable overlap between the radiation pattern of this BTS with a neighboring BTS. If so, the antenna module down tilt is increased at step 702. Thereafter, processor 660 again determines if the signal level is beyond acceptable limits. When the presence of an excessively high foreign SAT/RSSI signal is not detected, processor 660 proceeds to step 703.

At step 703, processor 660 determines if the foreign SAT/RSSI signal level is below allowable limits, indicating very little, or possibly no, overlap between the radiation pattern of this BTS with a neighboring BTS. If so, the antenna module down tilt is decreased at step 704. Thereafter, processor 660 again determines if the signal level is below allowable limits. When the presence of an excessively low foreign SAT/RSSI signal is not detected, processor 660 proceeds to repeat the algorithm.

Of course, although the use of SAT and RSSI signals has been discussed above, any communication parameters suitable to indicate the need for adjusting the tilt of the antenna modules, or antenna clusters, of the present invention may be used, if desired. For example, C to I ratio, energy density, or the like may be utilized by processor 660 in the determination to adjust the tilt of the antenna modules. Moreover, control signals from other BTSes may be utilized by processor 660 in its determination of adjusting the tilt of the antenna modules. For example, where a neighboring BTS is experiencing undesirable interference and has adjusted tilt of its associated antenna modules to produce a minimum radiation pattern, or such tilting is not available, this neighboring BTS may provide a control signal to processor 660 to result in its adjusting of the tilt to improve communication at the neighboring BTS.

Moreover, control of a cellular system of the antenna systems of the present invention may be accomplished centrally in order to provide optimum coverage with a minimum of inter BTS interference. Here, for example, a signal may be provided to processor 660 by a central intelligence to result in system wide signal improvement. Alternatively, the function of processor 660 may be wholly located at this central site, resulting in no autonomous control of the tilt by the individual BTS.

Additionally, a control system such as that illustrated in FIG. 6 may be utilized to adjust the beam width and azimuthal placement of the antenna module, as previously discussed. For example, a position motor similar to position motor 630 may be adapted to adjust placement of individual antenna elements or angles or placement of reflectors to result in an adjusted beam width. Such adjustment may be provided by the various control circuits discussed above utilizing communication parameters that not only look to effects of other BTS communications, but additionally or in the alternative, look to communication on other beams of the BTS. For example, beam width may be adjusted where co-channel interference is detected between two systems operating on two separate beams of the present invention.

Likewise, such control systems may be utilized to control the azimuthal placement of the antenna modules and, thus, their beams. For example, antenna modules may be twisted azimuthally to redirect a beam to cover a different area. Such a system might be utilized to provide coverage in a particular area where circuitry associated with another beam of the antenna system has failed. Similarly, an entire constellation of antenna modules may be twisted azimuthally. Such adjustment may be advantageous for providing coverage in an area where equipment failure has resulted in interruption, such as, for example, turning a "blind" spot to a lesser utilized area.

Although the present invention and its advantages have been described in detail, it should be understood that various changes, substitutions and alterations can be made herein without departing from the spirit and scope of the invention as defined by the appended claims.

What is claimed is:

1. A wireless communication antenna system adapted to provide communications within a substantially fixed geographic area, wherein said predetermined geographic area is neighboring a geographic area having wireless communication provided therein by an antenna other than said antenna, systems said antenna system comprising:

a plurality of radiating structures, each having a predetermined substantially directional radiation pattern, said radiating structures disposed to form a composite radiation pattern from said directional radiation patterns having a predetermined coverage area substantially corresponding to said substantially fixed geographic area; and automated means for physically adjusting the position of said radiating structures to result in said composite radiation pattern having an adjusted coverage area, wherein said adjusted coverage area is a different size than said predetermined coverage area, said size being determined at least in part as a function of wireless communication provided in said neighboring geographic area.

2. The system of claim 1, further comprising a radome incarcerating said plurality of radiating structures.

3. The system of claim 2, wherein radiating structures of said plurality of radiating structures are of a predetermined shape specifically adapted to allow their adjustment by said adjusting means while incarcerated by a radome having a minimal diameter.

4. The system of claim 3, wherein said predetermined shape comprises tapering of a distal end to provide a more narrow distal end.

5. The system of claim 3, wherein said predetermined shape is selected from the group of shapes consisting of:

a hexagon;

an ellipse;

a circle;

a trapezoid; and a triangle.

6. The system of claim 1, wherein said plurality of radiating structures is divided into at least two discrete clusters of radiating structures, and wherein radiating structures of said clusters are of a predetermined shape to allow their vertical disposition such that radiating structures of a first cluster of said clusters are only partially physically interposed with radiating structures of a second cluster of said ones of said clusters to thereby provide a large aspect ratio antenna system, said predetermined shape providing gaps in composite surface formed by each said cluster of said radiating structure allowing adjustment of said radiating structures by said adjusting means when said radiating structures are interposed.

7. The system of claim 6, wherein said clusters are disposed such that said directional radiation patterns of said radiating structures of said clusters interleave to provide said composite radiation pattern.

8. The system of claim 1, wherein said adjusting means operates to adjust said radiating structures as a function of a control signal from a centralized controller operable to control a plurality of antenna systems to thereby result in signal improvement throughout said plurality of antenna systems, said plurality of antenna systems including said antenna system and said antenna other than said antenna system.

9. The system of claim 1, wherein said adjusting means operates to adjust said radiating structures as a function of a monitored communication parameter.

10. The system of claim 9, wherein said monitored communication parameter is selected from the group consisting of:

a supervisory audio tone;

a receive signal strength indicator;

a carrier to interference ratio; and a signal to noise ratio.

11. The system of claim 1, wherein ones of said radiating structures are a planar array of antenna elements.

12. The system of claim 1, wherein ones of said radiating structures are a corner reflector antenna assembly.

13. A system for adjusting a position of ones of a plurality of antenna modules, each antenna module of said plurality of antenna modules having a beam associated therewith compositing to form a substantially omni-directional radiation pattern, said system comprising:

means for identifying a communication parameter comprising;

a receive signal demodulator outputting at least a demodulated portion of a signal received by an antenna module of said plurality of antenna modules;

a reference signal generator outputting a reference signal; and a signal combiner for combining said demodulated portion of said received signal and said reference signal;

means for physically tilting said ones of said plurality antenna modules to provide an adjusted amount of down-tilt resulting in said composite radiation pattern having an adjusted size; and means for controlling said tilting means, said controlling means operable to control tilting of said antenna modules as a function of said identified communication parameter.

14. The system of claim 13, wherein said identified communication parameter is provided by centralized controlling means operating to control a plurality of antenna systems to thereby result in system wide signal improvement.

15. The system of claim 13, wherein said identified communication parameter is associated with a signal received by an antenna module of said plurality of antenna modules.

16. The system of claim 15, wherein said identified communication parameter is selected from the group consisting of:

a supervisory audio tone;

a receive signal strength indicator;

a carrier to interference ratio; and a signal to noise ratio.

17. The system of claim 13, wherein said tilting means comprises:

a servomotor electrically coupled to said controlling means and physically linked to said ones of said plurality of antenna modules.

18. The system of claim 13, wherein said controlling means comprises:

an input accepting said identified communication parameter;

a processor-based system having a memory associated therewith;

a tilting algorithm stored in said memory executable on said processor-based system, said algorithm being operable to determine the propriety of tilting ones of said plurality of antenna modules based at least in part on said input communication parameter; and an output for providing a control signal consistent with said determination of propriety of tilting said antenna modules to said tilting means.

19. The system of claim 13, further comprising a radio frequency transparent structure containing said plurality of antenna modules, said radio frequency transparent structure adapted to present a narrow profile.

20. The system of claim 19, wherein said plurality of antenna modules are adapted to allow substantial tilting by said tilting means while said antenna modules are contained by said radio frequency transparent structure.

21. The system of claim 20, wherein said antenna modules are shaped to at least partially conform to an interior cavity of said radio frequency transparent structure when said antenna modules are tilted.

22. The system of claim 20, wherein said antenna modules are shaped to form a composite of at least two trapezoids.

23. A method for adjusting a position of at least one antenna structure of a plurality of antenna structures, each antenna structure of said plurality of antenna structures having a predetermined narrow main lobe associated therewith, said plurality of antenna structures disposed circumferentially around a center point to provide substantially omni-directional coverage by said main lobes, said method comprising the steps of:

identifying a communication attribute, wherein said step of identifying a communication attribute comprises the steps of:

demodulating a signal received by an antenna structure of said plurality of antenna structures;

generating a reference signal; and combining at least a portion of said demodulated received signal and said reference signal;

tilting at least one antenna structure of said plurality antenna structures to result in a changed area covered by said main lobe associated with said at least one antenna structure; and automatically controlling said tilting step as a function of said identified communication attribute.

24. The method of claim 23, further comprising the step of:

controlling said tilting step as a function of a signal provided by a remote control system.

25. The method of claim 23 wherein said identified communication attribute is associated with a signal received by an antenna structure of said plurality of antenna structures.

26. The method of claim 23, wherein said tilting step comprises:

electrically controlling a motorized apparatus physically linked to at least one antenna structure of said plurality of antenna structures.

27. The method of claim 23, wherein said controlling step comprises:

accepting said identified communication attribute;

determining the appropriateness of tilting at least one antenna structure of said plurality of antenna structures based at least in part on said accepted communication attribute; and outputting a control signal consistent with said determination of appropriateness of tilting said at least one antenna structure of said plurality of antenna structures.

28. An antenna system comprising:

a plurality of antenna modules spaced circumferentially around a support structure, each antenna module having a predetermined narrow communication beam, said antenna modules disposed around said support structure to provide substantially omni-directional communication within a predefined area;

means for determining a communication aspect, wherein determination of said communication aspect is based at least in part on information available at a centralized controller operable to control a plurality of antenna systems; and means for automatically adjusting the attitude of at least one antenna module of said plurality of antenna modules as a function of said determined communication aspect to result in said predefined area being adjusted in shape, said adjusting means comprising:

an input accepting said determined communication aspect;

a processor-based system having a memory associated therewith;

an algorithm stored in said memory executable on said processor-based system, said algorithm being operable to determine the appropriateness of adjusting the attitude of said at least one antenna module based at least in part on said input communication aspect.

29. The system of claim 28, wherein determination of said communication aspect is based at least in part on information available from a signal received by an antenna module associated with said plurality of antenna modules.

30. The system of claim 28, wherein said adjusting means further comprises:

a servomotor coupled via at least one linkage to said at least one antenna module; and means for providing said servomotor a control signal consistent with said determination of appropriateness of adjusting the attitude of said at least one antenna module.

31. The system of claim 28, further comprising a radome enveloping said plurality of antenna modules.

32. The system of claim 31, wherein ones of said antenna modules are shaped to partially conform to an interior cavity of said radome when adjusted to result in a minimum sized said predefined communication area, and wherein said radome has a diameter predetermined to be a substantially minimal diameter sufficient to contain said plurality of antenna modules when said at least one antenna module is adjusted to result in a minimum sized said predefined communication area.

33. The system of claim 32, wherein said ones of said antenna modules are of a predetermined shape selected from the group consisting of:

a hexagon;

an ellipse;

a circle;

a trapezoid; and a triangle.

34. The system of claim 28, wherein said plurality of antenna modules is divided into at least two discrete clusters of antenna modules.

35. The system of claim 34, wherein ones of said clusters are disposed such that said narrow communication beams associated with antenna modules of each of said antenna clusters interleave to provide said substantially omni-directional communication coverage.

36. The system of claim 34, wherein antenna modules of said ones of said clusters are of a predetermined shape to allow their vertical disposition on said support structure such that at least a portion of a first cluster of said at least two clusters is physically interposed with at least a portion of a second cluster of said at least two clusters.

37. The system of claim 28, wherein ones of said antenna modules are a planar array of antenna elements.

38. The system of claim 28, wherein ones of said antenna modules are a corner reflector antenna assembly.

39. A system for adjusting a position of ones of a plurality of antenna modules, each antenna module of said plurality of antenna modules having a beam associated therewith compositing to form a substantially omni-directional radiation pattern, said system comprising:

means for identifying a communication parameter, wherein said identified communication parameter is provided by centralized controlling means operating to control a plurality of antenna systems to thereby result in system wide signal improvement;

means for physically tilting said ones of said plurality antenna modules to provide an adjusted amount of down-tilt resulting in said composite radiation pattern having an adjusted size; and means for controlling said tilting means, said controlling means operable to control tilting of said antenna modules as a function of said identified communication parameter.

40. The system of claim 39, further comprising a radio frequency transparent structure containing said plurality of antenna modules, said radio frequency transparent structure adapted to present a narrow profile, wherein said plurality of antenna modules are adapted to allow substantial tilting by said tilting means while said antenna modules are contained by said radio frequency transparent structure.

41. The system of claim 40, wherein said antenna modules are shaped to at least partially conform to an interior cavity of said radio frequency transparent structure when said antenna modules are tilted.

* * * * *